US005706739A

United States Patent [19]

Shaheen et al.

[11] Patent Number: 5,706,739

[45] Date of Patent: Jan. 13, 1998

[54] HEIGHT ADJUSTABLE COUNTERBALANCE WORKSTATION

[75] Inventors: Hanna Shaheen, Scarborough; John Laperle, Cornwall; Dragan Grbic, Scarborough; Lee Kenyon, Sharon, all of Canada

[73] Assignee: Ergotech (1993) Inc., Scarborough, Canada

[21] Appl. No.: 764,299

[22] Filed: Dec. 12, 1996

[51] Int. Cl.[6] ..... A47B 9/00

[52] U.S. Cl. ..... 108/147; 108/146; 248/167.1

[58] Field of Search ..... 108/147, 146, 108/144, 148; 248/188.5, 162.1, 404, 414, 157

[56] References Cited

U.S. PATENT DOCUMENTS

| | | | |
|---|---|---|---|
| 3,194,187 | 7/1965 | Linder et al. | 108/146 |
| 4,601,246 | 7/1986 | Damico | 108/146 X |
| 4,619,208 | 10/1986 | Kurrasch | 108/147 X |
| 4,747,353 | 5/1988 | Watt | 108/147 X |
| 4,981,085 | 1/1991 | Watt | 108/146 X |
| 5,016,846 | 5/1991 | Solomon | 108/146 X |
| 5,289,782 | 3/1994 | Rizzi et al. | 108/146 X |
| 5,400,721 | 3/1995 | Greene | 108/147 |
| 5,408,940 | 4/1995 | Winchell | 108/147 |
| 5,423,502 | 6/1995 | Thomason et al. | 108/146 X |
| 5,549,053 | 8/1996 | Grout | 108/147 |

*Primary Examiner*—Jose V. Chen

[57] ABSTRACT

A height adjustable workstation uses a torsion spring in association with a transmission for providing a counterbalance force opposing downward forces applied to the work surface. The workstation has telescoping legs and the telescopic movement thereof is transmitted through the transmission system to the torsion spring. The torsion spring is loaded and applies the counterbalance force to the legs via the transmission. The system includes a hand engaging adjustment mechanism for varying the magnitude of the counterbalance force and also includes a lock arrangement for locking the workstation at various selected positions. The preferred transmission system includes a rack and pinion gear arrangement connected to the torsion spring by a shaft.

20 Claims, 5 Drawing Sheets

FIG. 1.
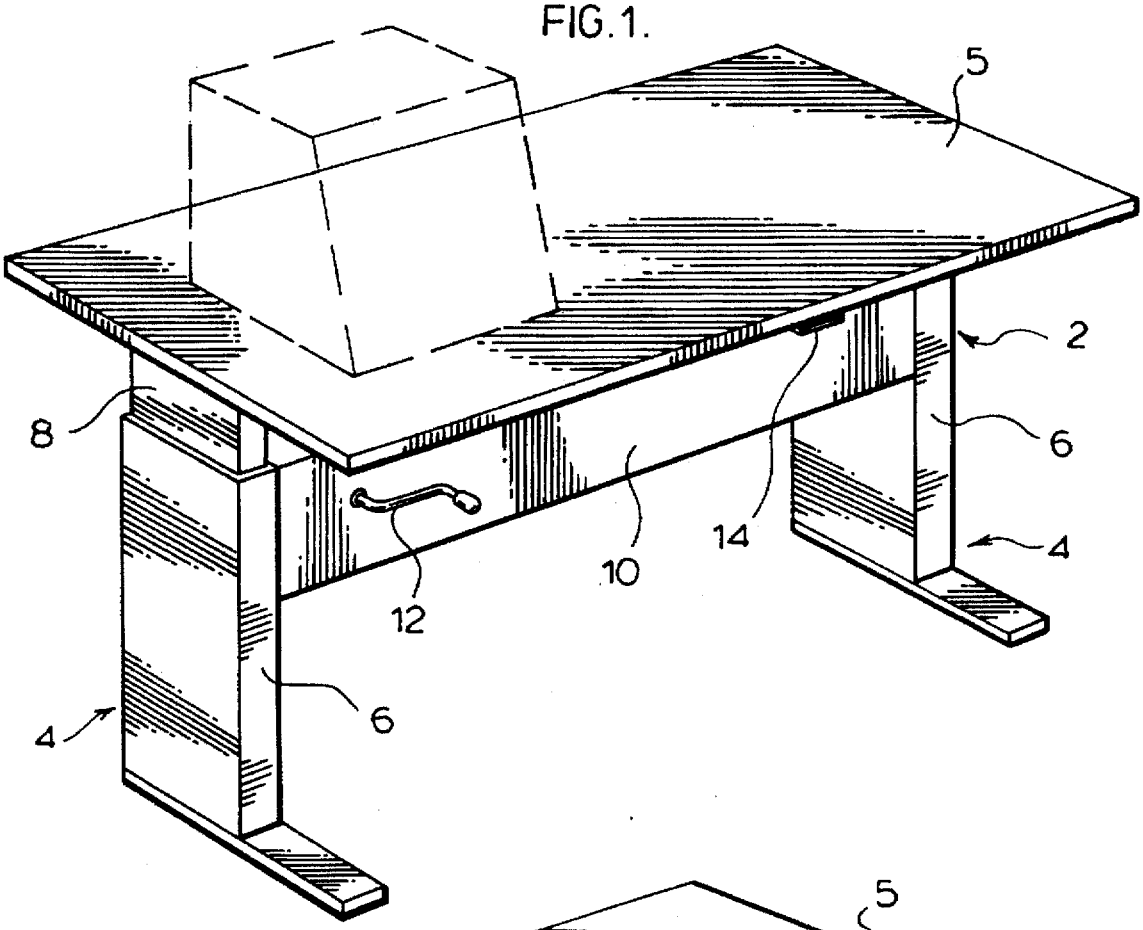
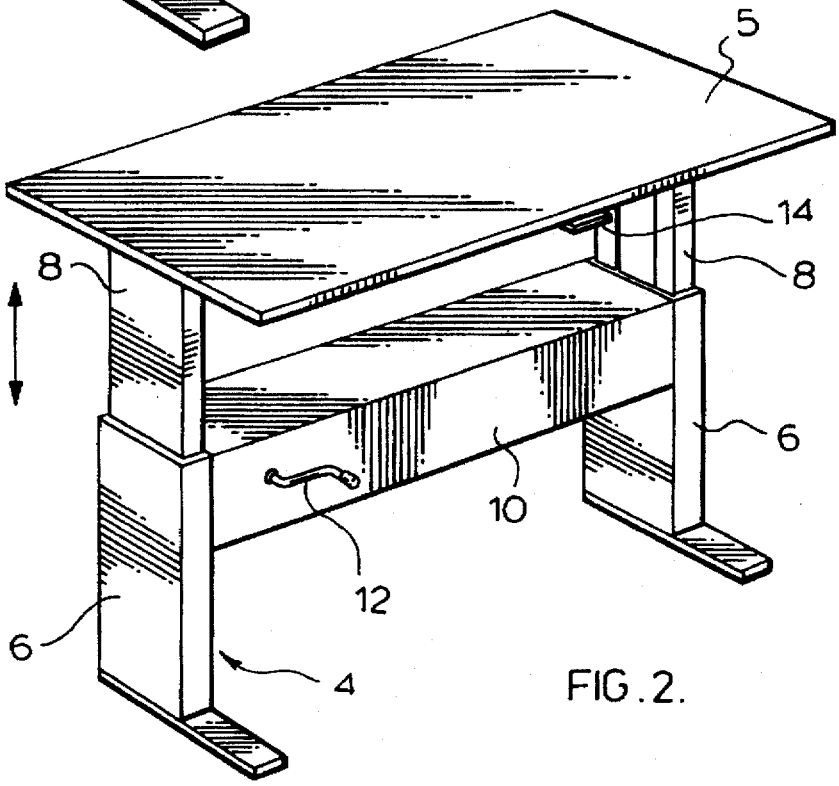
FIG. 2.

HEIGHT ADJUSTABLE COUNTERBALANCE WORKSTATION

FIELD OF THE INVENTION

The present invention relates to height adjustable workstations and in particular relates to workstations which can be manually adjusted to different heights and which use a spring type counterbalance arrangement.

BACKGROUND OF THE INVENTION

Height adjustable workstations are exposed to widely varying loads and are frequently height adjusted to accommodate different users and to accommodate a host of positions between standing and sitting.

Workstations are designed to have various equipment supported thereon and must be capable of responding to widely varying loads which change from time to time. This is in contrast to height adjustable drafting boards where the load is constant and unchanging. Examples of height adjustable drafting boards are shown in U.S. Pat. Nos. 3,273,517 and 3,638,584.

The wide variation in user position and the widely varying counterbalance force necessary to adjust for different loads applied to the workstation from time to time makes the workstation application much more complicated and demanding than other applications, such as drafting boards, where there is no substantial variation in the applied load. The primary load of a drafting board arrangement is the fixed known weight due to the movable structure.

There are a number of workstations which allow for the adjustment of a work surface between different levels. The ability to easily adjust the height of a work surface is desirable to accommodate different operators and also to allow an operator to change their work position throughout the day.

Some workstations include electric motors and provide the user with a wide degree of flexibility in adjusting the level of the work surface. The electric motor can also function as a brake and locks the work surface at any of the positions. An example of a motorized workstation is shown in U.S. Pat. No. 4,440,096.

In some cases, it is desirable to have a manual type counterbalance arrangement which is less expensive and less subject to service problems. An example of a spring loaded counterbalance arrangement is shown in U.S. Pat. No. 5,181,620. In this system a large frame and a series of springs are used to reduce the variation in the spring force due to height adjustment. As can be appreciated, a manual counterbalance workstation is adjustable at the time of installation, such that the counterbalance force generally equals the combined gravity force of the work surface and any components thereon. Problems can occur overtime where the components change causing an imbalance between the counterbalance force and the gravity force. This imbalance, if not recognized and corrected, by adjusting the counterbalance force, can produce a safety risk when the work surface is released for height adjustment and surprisingly moves rapidly due to the imbalances.

Existing counterbalance arrangement for workstations are not easily adjusted by a user, are expensive to manufacture and do not address the possible imbalance in the counterbalance force.

SUMMARY OF THE INVENTION

A height adjustable work table according to the present invention comprises a planar work surface supported by opposed leg assemblies, each leg assembly including a base leg and an upper leg having a variable overlap with the base leg to vary the height of the planar work surface. A transmission system connects the leg assemblies, and the transmission system includes a loaded torsion spring held at one end with the other end of the torsion spring winding or unwinding the torsion spring as the extent of overlap of the leg varies. The torsion spring cooperates with the transmission system to provide a counterbalance force opposing a downward force tending to increase the overlap of the legs. A hand engaging adjustment mechanism is provided for varying the extent the torsion spring is wound and thereby vary the counterbalance force, and a locking mechanism is provided for fixing the leg assemblies in various selected positions.

According to an aspect of the invention, the lock mechanism includes a load sensing mechanism and maintains the leg assemblies fixed if the counterbalance force and the downward force are substantially out of balance.

According to a further aspect of the invention, the transmission system includes a generally horizontal shaft with two pinion gears fixed at opposite ends of the shaft with each pinion gear in mesh with a rack fixed to the upper legs such that raising or lowering of the planar work surface causes rotation of the pinion gears and the shaft.

According to a further aspect of the invention, the torsion spring has one end thereof attached to the shaft and rotates with the shaft to cause the winding or unwinding of the spring as the work surface is raised or lowered.

According to a further aspect of the invention, the torsion spring, the shaft, and pinion gears are enclosed in a modesty panel with the modesty panel joining the base legs at an upper part thereof.

According to an aspect of the invention, the adjustment mechanism comprises a worm in mesh with a gear which is attached to the one end of the torsion spring to cause winding or unwinding of the torsion spring. The worm includes a crank passing through the modesty panel for rotating the worm. The worm and gear have a drive ratio such that the worm acts as a lock for the gear maintaining the gear in an adjusted position.

BRIEF DESCRIPTION OF THE DRAWINGS

Preferred embodiments of the invention are shown in the drawings, wherein:

FIG. 1 is a perspective view of a variable height workstation;

FIG. 2 is a similar view to FIG. 1 with the work surface at a higher level;

DETAILED DESCRIPTION OF THE PREFERRED EMBODIMENTS

Figure 3:
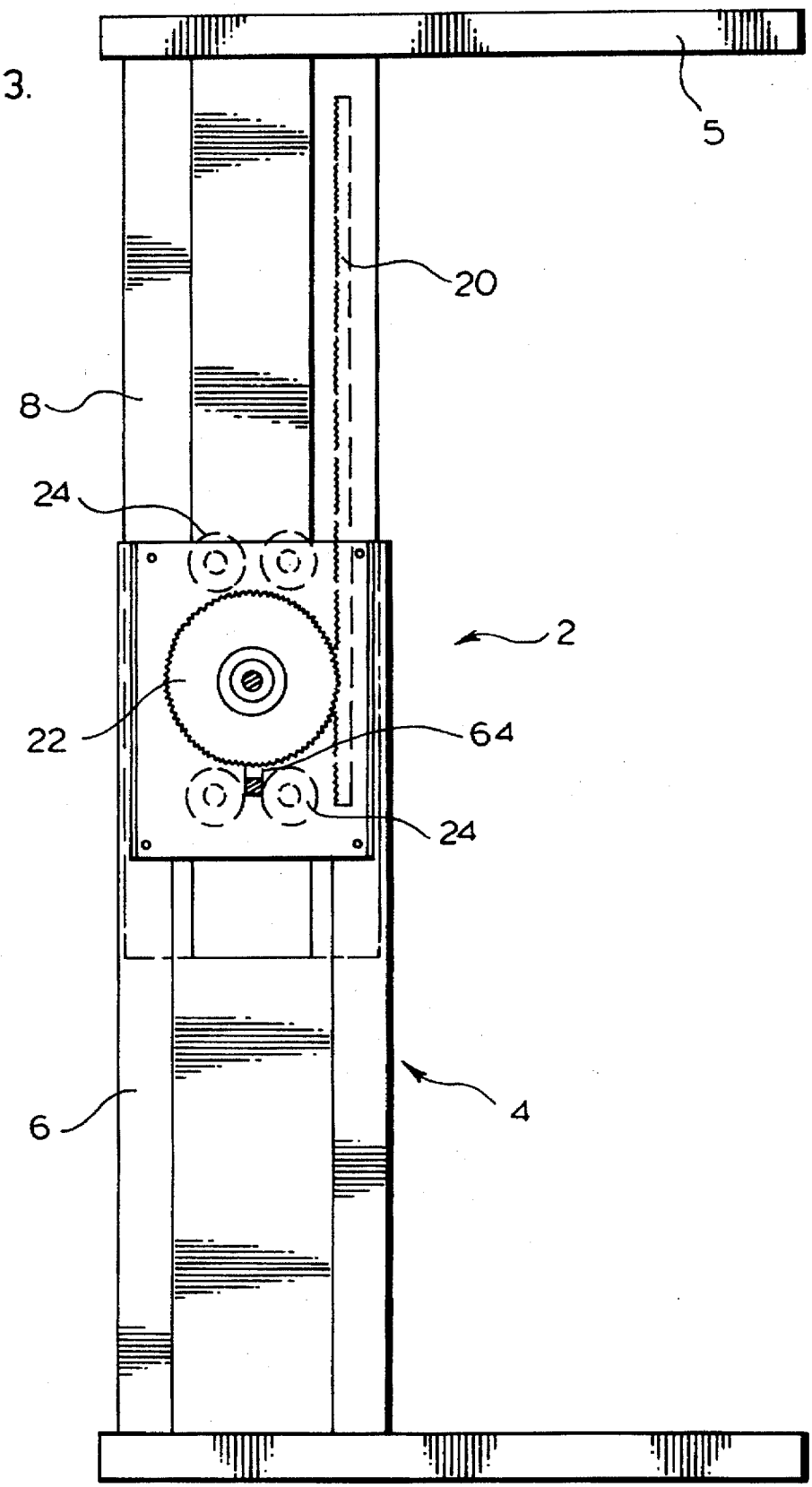
FIG. 3 is a side view illustrating the cooperation between the telescopic legs of the workstation.

The workstation 2, shown in FIGS. 1 and 2, has opposed leg arrangements 4 either side of the workstation with each leg arrangement having a lower leg 6 which receives in a telescoping manner the upper leg 8. A modesty panel 10 interconnects the leg arrangements and a crank 12 is shown extending from one side of the modesty panel. This crank is used for adjustment of the counterbalance arrangement.

A release mechanism 14 is secured to the underside of the work surface 5 and this release mechanism allows an operator, if the appropriate load conditions are present, to release the lock assembly and adjust the height of the work surface 5 appropriately. If the load conditions are not appropriate, the workstation remains locked.

Figure 4:
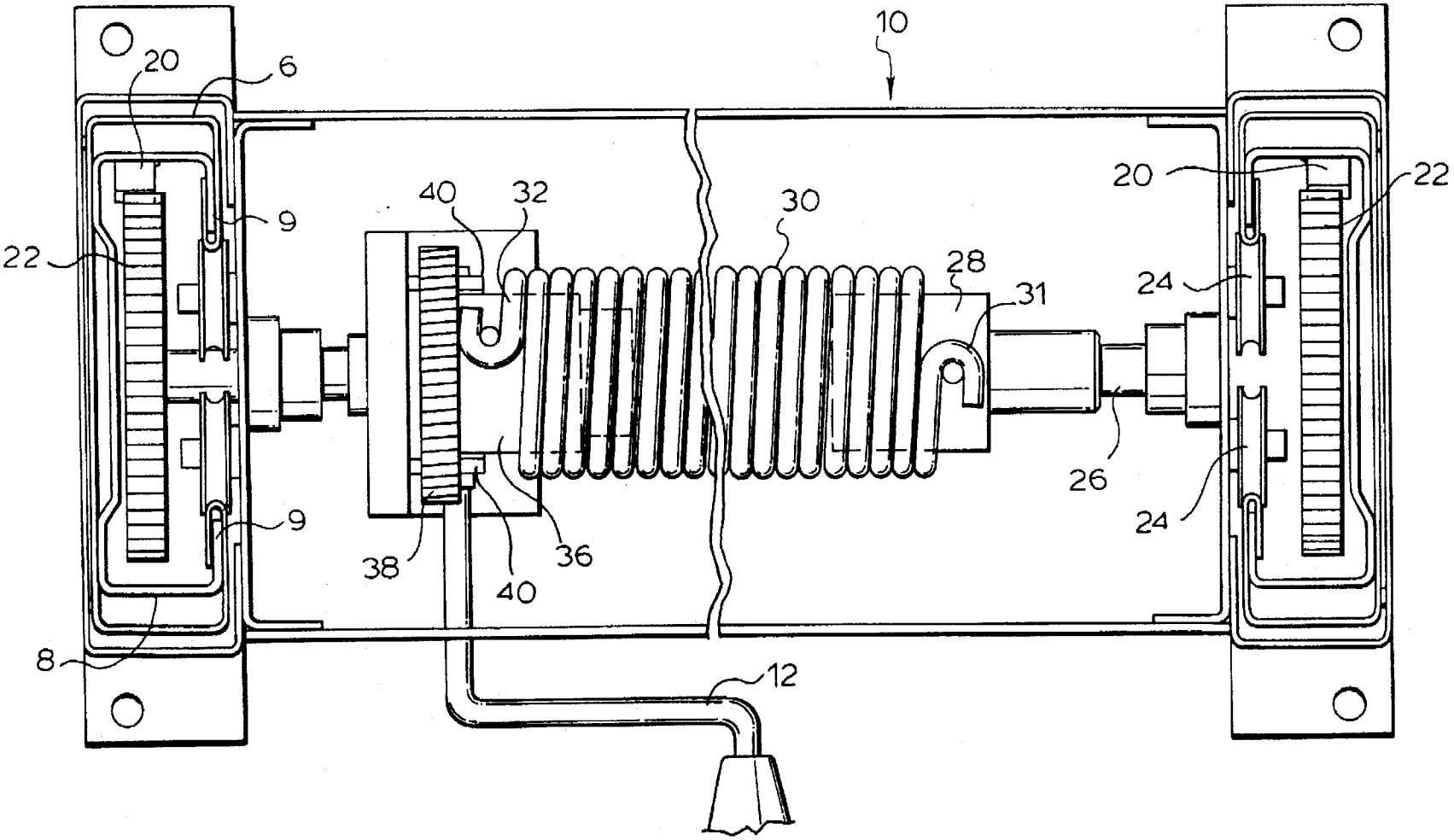
FIG. 4 shows details of the torsion spring counterbalance arrangement and its interconnection to the telescoping legs.

As shown in FIGS. 3 and 4, each of the leg arrangements include a rack 20 which is fixed to the upper leg 8. The rack 20 meshes with the spur gear 22 supported on the gear shaft 26 which is supported within the modesty panel 10. Adjustment of the work surface, up or down, requires the rack 20 to move relative to the spur gears 22 and causes rotation of the shaft 26. As can be appreciated, the racks 20 and the spur gears 22 are interconnected by means of the shaft 26, and therefore, the work surface is maintained in its horizontal plane and will not become lopsided due to an uneven load on the work surface. Any movement of one side of the work surface downwardly requires a similar movement of the other edge of the work surface.

The inner leg 8 is basically "U" shaped and has inwardly extending flanges 9. These flanges are received and guided by the guide rollers 24 secured within the modesty panel. The rollers and flanges maintain alignment of the legs.

End 31 of the torsion spring 30 is fixed to the collar 28, which in turn is welded or fixed on the shaft 26. Therefore, collar 28 rotates with rotation of the shaft 26. The torsion spring basically is coaxial with the shaft 26 and end 32 of the torsion spring 30 is welded or fixed to the bearing 36. This bearing is supported on the tube support 50 shown in FIG. 5. The bearing 36 is fixed to the gear 38 and is independent of rotation of the shaft 26. As can be seen, the support tube 50 is attached to bracket 51, which is secured within the modesty panel. Gear 38 is in mesh with the worm 40, shown in FIG. 6, which is driven by the crank 12. The tube support 50 also receives the stop member 42 which serves to maintain the position of the gear 38 and the bearing 36 on the tube support. A set screw 43 is provided on the stop 42 and opposes any force trying to remove the stop from the tube support. Thus, bearing 36 is free to rotate on the tube support 50, but the position on the tube support relative to the length of the tube support is fixed.

Figure 5:
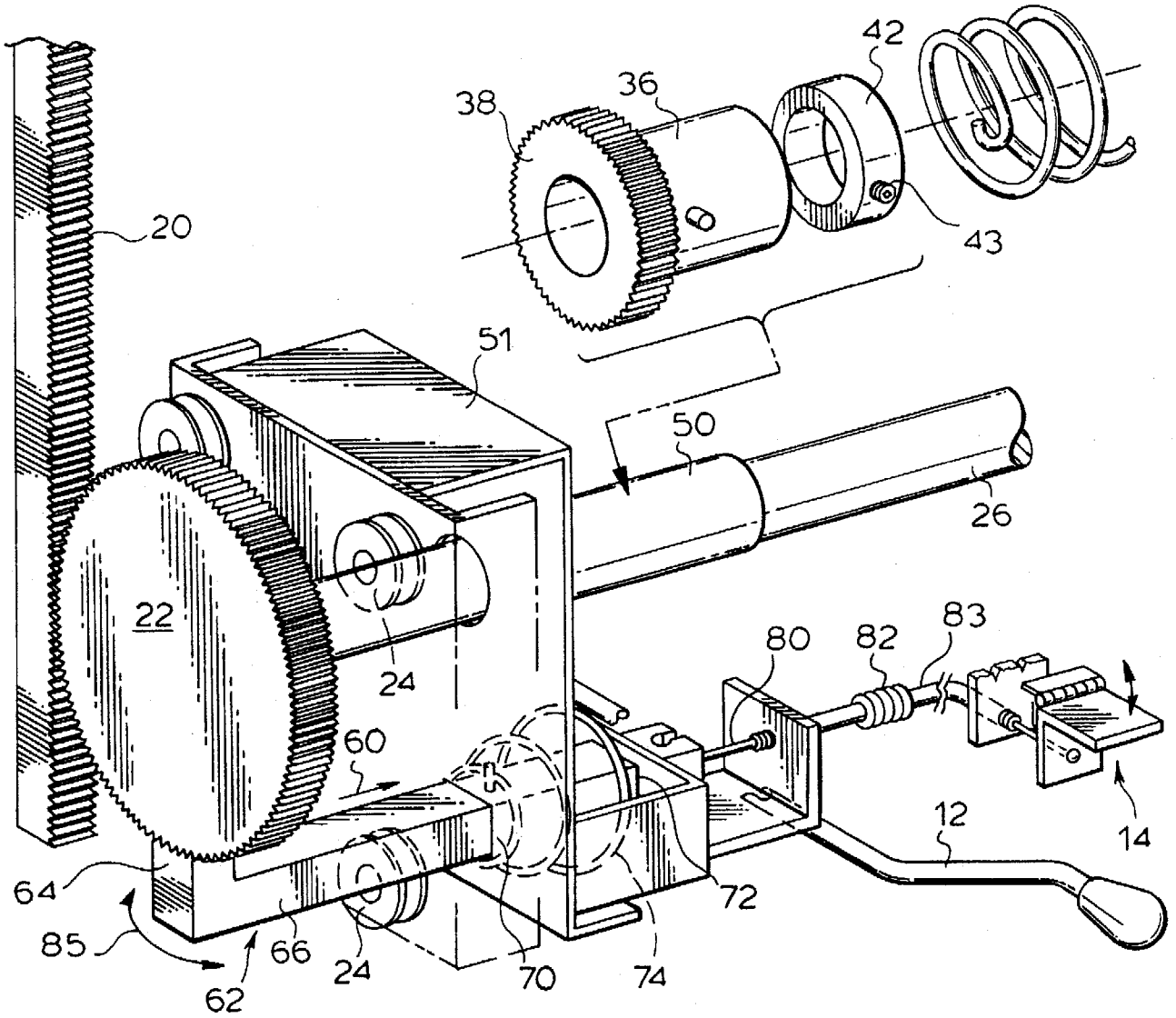
FIG. 5 is a partial perspective view showing the support of one end of the torsion spring and shows details of a locking arrangement.
Figure 6:
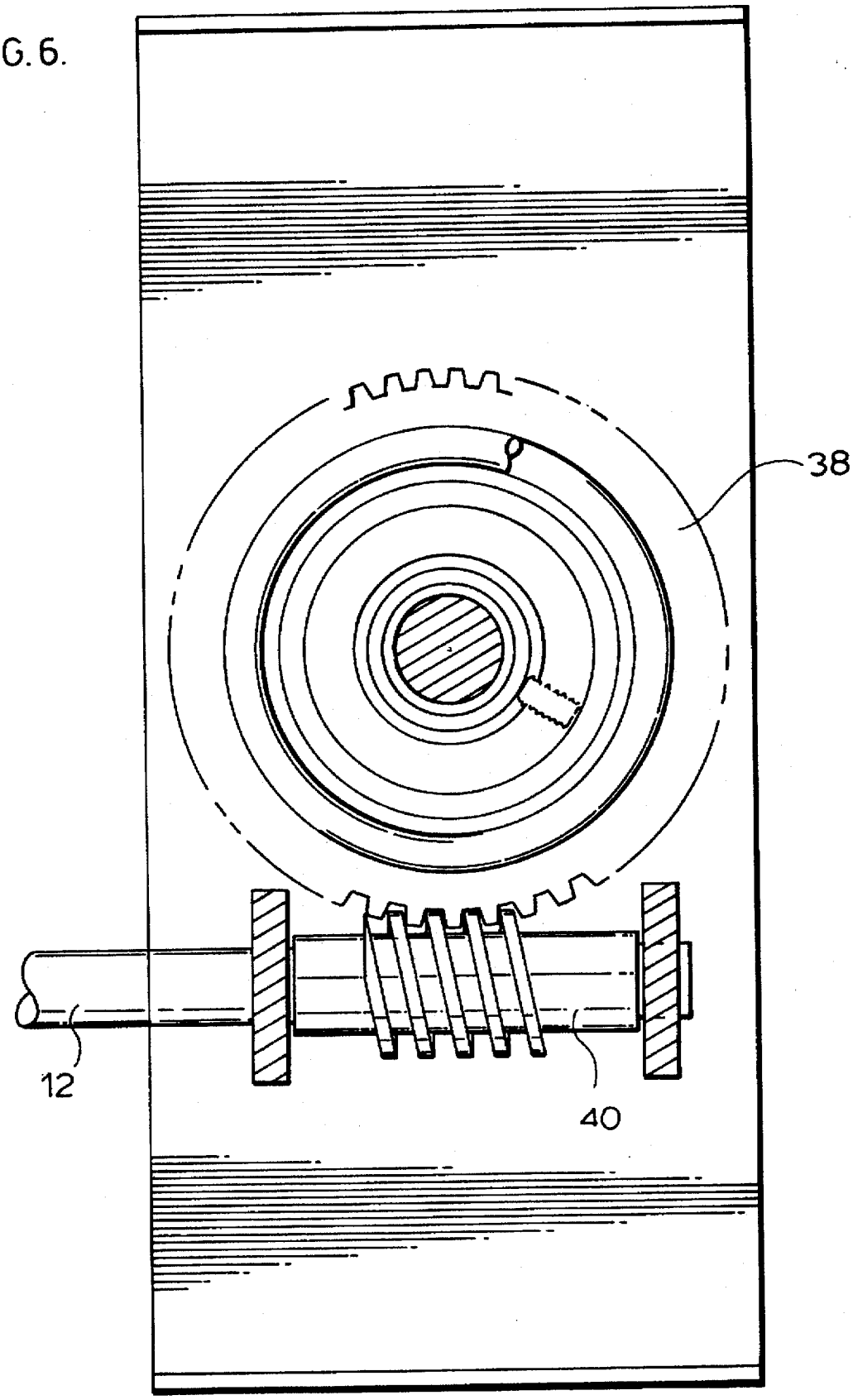
FIG. 6 illustrates the manual adjustment of the torsion spring by means of a crank.

Before discussing adjustment of the counterbalance force, it is worthwhile to consider the slide lock 62 shown in FIG. 5. This slide lock basically prevents rotation of the spur gear 22, and thus, locks the work surface at a fixed height. To adjust the height, the slide lock 62 must move to a release position where it is not engaging the spur gear 22. The slide lock 62 has a square shaft, generally shown as 66, which is supported within the modesty panel and passes through square ports 70 and 72. Square shaft 66 includes, at its free end, head 64 provided with teeth which mesh with the spur gear 22.

Spur gear 22 can have a load applied thereto by the rack 20 and is also exposed to the load exerted by the torsion spring 30 on the shaft 26. Ideally, the force exerted on the spur gear by means of the shaft 26 will approximately equal the force exerted on the spur gear through rack 20. Under these circumstances, the slide lock 62 easily disengages the spur gear 22 by sliding, as indicated by arrow 60. This compresses the spring 74, which tries to maintain the slide lock in engagement with the spur gear 22. In any event, the head 64 can move to a position clear of the spur gear and allow rotation of the spur gear, and thus, rotation of the shaft 26.

It can also be appreciated that conditions can change on a workstation that would cause an unbalanced force to exist on the spur gear 22. For example, if additional equipment having substantial weight is added to the work surface, the downward force exerted by rack 20 on the spur gear will not be equal to the force exerted by the torsion spring, which was established under different circumstances. In this case, spur gear 22 will exert a certain force on head 64 causing a cocking of the square shaft 66, indicated by the rotation 85. This cocking of the square shaft 66 will cause it to bind within the squared ports 70 and 72 and shaft 66 will not slide in the direction of arrow 60. Similarly, if a large amount of weight is removed from the work surface, which was previously counterbalanced by the torsion spring 30, then there can be a net upward force exerted by the torsion spring on the shaft 26. Again, this will cause a cocking of the shaft and locking of shaft 66 such that a user will not be able to adjust the height of the work surface. It is dangerous for a worker to adjust the system when it is out of balance. Release paddle 14 is moved by a user and this causes a sympathetic movement of a mechanical linkage having a variable link. In this case, a cable 80 is attached to one end of the shaft 66. There is some spring or length adjustment provided in the cable 83, which is indicated by the member 82. If the shaft 66 is locked due to an uneven force, the spring 82 will allow a compression of the sheath such that the paddle release 14 will bottom out against the work surface without moving the shaft 66. This provides a safety feature in that the user cannot overpower the paddle release 14 if the shaft 66 is locked. This is important, where too much weight is on the work surface and if lock 62 is released, the work surface will move rapidly downward. Similarly, if the torsion spring 30 is improperly loaded and is producing too much force, the work surface could move rapidly upward. Both of these conditions are dangerous to an operator and are avoided by the release mechanism.

FIG. 4 perhaps best shows how the load on the torsion spring can be varied by an operator. The operator rotates crank 12, which in turn causes rotation of the worm 40 which drives the gear 38. Gear 38 is fixed to the bearing 36 and causes a rotation thereof and also causes rotation of the end 32 of the torsion spring. In this way, the torsion spring can be wound or unwound and the load thereof can be easily changed. The torsion spring 30 has been selected to have a generally linear type response and it has also been selected and is of length to provide a relatively constant force over the maximum range of height adjustment of approximately 16 inches. The ratio of the spur gear to the rack can also be selected to minimize the effect on the torsion spring 30. For example, these are set such that the shaft 26 only revolves about 2½ times over the full height adjustment such that the spring force is generally constant. For every rotation of the worm the spring force changes approximately 1 pound. The torsion spring is selected to provide a counterbalance force sufficient to allow up to 150 lbs. of equipment to be added to the work surface.

From the above, it can be appreciated that a very simple, low profile counterbalance arrangement is possible which allows an operator to easily adjust the work surface. Given that the force exerted by the torsion spring 30 approximately equals the weight exerted on the spur gears, paddle release 14 will release the slide lock 62 and the user can then provide the additional force to either raise or lower the work surface. If the condition on the work surface is changed and the counterbalance force is out of balance, the slide lock 62 does not work and the user must adjust the load by manipulation of the crank 12. Adjustment of the height is only possible after a proper counterbalance force has been reestablished. The relationship of the worm and the gear 38 is such that the worm basically acts as a lock for the gear 38. The force exerted on the gear 38 by means of the torsion spring 30 cannot cause a rotation of the worm due to the drive relationship therebetween. This provides a safe working condition for the user.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A height adjustable workstation comprising a planar work surface supported by opposed leg assemblies, each leg assembly including a base leg and an upper leg having a variable overlap with said base leg to vary the height of the planar work surface, a transmission system connecting said leg assemblies, said transmission system included a loaded torsion spring held at one end with the other end of said torsion spring winding or unwinding said torsion spring as the extent of overlap of said leg varies, said torsion spring cooperating with said transmission system to provide a counterbalance force opposing a downward force tending to increase the overlap of said legs, a hand engaging adjustment mechanism for varying the extent the torsion spring is wound and thereby vary the counterbalance force, and a locking mechanism for fixing said leg assemblies in a selected position when said locking mechanism is locked and allowing adjustment of the height of the work surface when said locking mechanism is released.

2. A workstation as claimed in claim 1 wherein said lock mechanism includes a load sensing mechanism and maintains said leg assemblies fixed if said counterbalance force and said downward force are substantially out of balance.

3. A workstation as claimed in claim 1 wherein said locking mechanism when locked is exposed to said counterbalance force and said downward force and said locking mechanism is moved to a binding position urging said locking mechanism to remain locked when said counterbalance force is not approximately equal to said downward force.

4. A workstation as claimed in claim 3 wherein said transmission system includes a generally horizontal shaft with two pinion gears fixed at opposite ends of said shaft with each pinion gear in mesh with a rack fixed to said upper legs such that raising or lowering of said planar work surface causes rotation of said pinion gears and said shaft.

5. A workstation as claimed in claim 4 wherein said torsion spring has one end thereof attached to said shaft and rotates with said shaft to cause said winding or unwinding of said spring as said work surface is raised or lowered.

6. A workstation as claimed in claim 5 wherein said torsion spring is coaxial with said shaft.

7. A workstation as claimed in claim 5 wherein said torsion spring and said shaft and pinion gears are enclosed in a modesty panel with said modesty panel joining said base legs at an upper part thereof.

8. A workstation as claimed in claim 7 wherein said adjustment mechanism comprises a worm in mesh with a gear which is attached to said one end of said torsion spring to cause winding or unwinding of said torsion spring, said worm including a crank passing through said modesty panel for rotating said worm, said worm and gear having a drive ratio such that said worm acts as a lock for said gear maintaining said gear in an adjusted position.

9. A workstation as claimed in claim 8 wherein said upper leg of each leg assembly telescopes within the associated base leg.

10. A workstation as claimed in claim 9 wherein said planar work surface has a height adjustment range of about 16 inches.

11. A workstation as claimed in claim 8 wherein said torsion spring is coaxial with said shaft.

12. A workstation as claimed in claim 11 wherein said torsion spring is held in said modesty panel in an elongated manner.

13. A workstation as claimed in claim 12 wherein said torsion spring over the range of adjustment of said planar work surface undergoes less than 3 rotations to wind or unwind said torsion spring.

14. A workstation as claimed in claim 13 wherein said rack and pinion gears have a drive ratio to cause about 2½ windings of said torsion spring when said work surface is moved from a maximum height position to a minimum height position.

15. A workstation as claimed in claim 3 wherein said workstation is designed to be adjustable for the weight of equipment supported on said work surface wherein the weight of the equipment is not to exceed 150 lbs.

16. A workstation as claimed in claim 3 wherein said lock mechanism includes a sliding member which engages and locks one of said pinion gears against further rotation, said sliding member being movable from a locked position engaging said one pinion gear to a clear position to one side of said one pinion gear.

17. A workstation as claimed in claim 1 wherein said sliding member meshes with said one pinion gear in the locked position and slides in a traverse direction relative to said one gear to the clear position.

18. A workstation as claimed in claim 17 wherein said sliding member includes a shaft slidable in a support arrangement and biased to the locked position, said support arrangement locking said shaft and said sliding member against sliding movement when said one gear applies a torque to said locking member due to an unbalanced condition between said counterbalance force and said downward force.

19. A workstation as claimed in claim 18 wherein said shaft of said sliding member is noncircular in cross section and binds with said support arrangement in said unbalanced condition.

20. A workstation as claimed in claim 19 wherein said lock mechanism includes a release lever having a mechanical linkage connecting said sliding member and said release lever to cause sliding of said sliding member between the locked position and the clear position when said release lever is actuated by a user and said counterbalance force and said downward force are generally balanced and wherein said mechanical linkage a automatically adjusts in length to accommodate said release lever being actuated when said sliding member is held in the locked position due to an unbalanced condition.

* * * * *